US005408061A

United States Patent [19]

Martin

[11] Patent Number: 5,408,061

[45] Date of Patent: Apr. 18, 1995

[54] EMERGENCY STOP SWITCH

[75] Inventor: Adolf H. Martin, Glenview, Ill.

[73] Assignee: Inventio AG, Hergiswil, Switzerland

[21] Appl. No.: 159,143

[22] Filed: Nov. 30, 1993

[51] Int. Cl.[6] ..... H01H 15/24

[52] U.S. Cl. ..... 200/538; 200/537; 200/539; 200/542

[58] Field of Search ..... 200/538, 537, 539, 542; 700/506, 508, 1 B, 533, 573, 579

[56] References Cited

U.S. PATENT DOCUMENTS

| | | | |
|---|---|---|---|
| 3,902,032 | 8/1975 | Koepke | 200/506 |
| 4,255,633 | 3/1981 | Johnston et al. | 200/538 |
| 4,385,219 | 5/1982 | Finlayson | 200/506 |
| 4,404,445 | 9/1983 | Bara et al. | 200/314 |
| 4,504,713 | 3/1985 | Hennessey | 200/241 |
| 4,703,141 | 10/1987 | Grunst | 200/340 |
| 5,012,056 | 4/1991 | Abel et al. | 200/539 |

FOREIGN PATENT DOCUMENTS

| | | |
|---|---|---|
| 1957370 | 8/1966 | Germany . |
| 3207725 | 9/1983 | Germany . |
| 8527547 | 3/1986 | Germany . |

*Primary Examiner*—Henry J. Recla
*Assistant Examiner*—David J. Walczok
*Attorney, Agent, or Firm*—Sandler, Greenblum & Bernstein

[57] ABSTRACT

In the subject emergency stop switch the closing ring penetrates through a face plate, surrounds a pushbutton, and on its rear side is in communication with a control element that is provided for the guidance of a cam, preloaded via a first spring. A first plunger element, in connection with the pushbutton, includes elements for the reception of the cam and the first spring and an adaptor, superimposed on a contact block, surrounds the control element, with the first plunger element actuating, upon a force input via the pushing of the pushbutton, a contact carrier, guided by a contact block, against the resilient force provided by springs. In this manner the contact sets are opened and arched contact arms are utilized which are accessible via connecting terminals with the contact arms being pretensioned in such a manner that they close the contact upon the pushing of the pushbutton.

11 Claims, 4 Drawing Sheets

EMERGENCY STOP SWITCH

BACKGROUND OF THE INVENTION

1. Field of the Invention

This invention pertains to an emergency stop switch comprised of an adaptor superimposed upon a contact block, a contact carrier with contact sets, a closing ring and a pushbutton which actuates the contact sets with the contact carrier, the contact carrier being arranged in the contact block and preloaded via the spring force of second springs, wherein the adaptor and the contact block are connected, via adaptor bosses and contact block bosses, with a face plate by means of threaded bolts and nuts.

2. Discussion of the Background of the Invention and Material Information

U.S. Pat. No. 4,504,713 discloses a pushbutton switch which is primarily comprised of a pushbutton, a closing ring penetrating a face plate, a contact carrier, a contact block and an adaptor located between the contact carrier and the closing ring. For the illumination of the pushbutton an axially located rod-shaped incandescent bulb is retained by the contact block. Springs, interposed between the contact block and the contact carrier, preload or tension the contact carrier with a spring load. A force, initiated via the plunger, displaces the contact carrier against the spring force, whereby the contacts, arranged on the contact carrier are separated from the contacts arranged on the contact block. The contacts and the incandescent bulb are accessible via connecting terminals arranged on the contact block.

SUMMARY OF THE INVENTION

The claimed invention solves the object or task of this invention by improving the previously noted switch so that it fulfills the requirements of an emergency stop switch in a modular constructional form.

One embodiment of the emergency stop switch of this invention comprises: an adaptor supported on a contact block having a first set of contacts; a contact carrier provided with a second set of contacts; a closing ring and a pushbutton, with the pushbutton actuating the contact sets with the contact carrier, and the contact carrier being arranged within the contact block and preloaded by the force of second or multiple springs; means for connecting the adaptors and the contact block via adaptor bosses and contact block bosses, with the face plate; at least two contact arms, with contacts, arranged at the contact block; the contact arms being actuated via a plunger element, with the plunger element being in connection with the pushbutton; a control element, within the adaptor; and multiple cams, with the cams being guided by the plunger element and actuated by the bias of a first or single spring, and the cams retaining the pushbutton in end positions via bevels, with the bevels being arranged at the closing ring and at the control element.

In the emergency stop switch of this invention the pushbutton includes first slots and first slot fins, which serve as the connection with the plunger element. The pushbutton also includes a pushbutton body having a structured surface; material-saving first bores on an underside thereof; and indicia markings on a top face thereof, with the indicia markings in turn providing a user of the switch with switch-specific information.

In another embodiment of this invention, the closing ring includes first stops, spring bolts, second bores, first bevels and first recesses; the first stops stopping the falling of the closing ring through an opening of the face plate; the spring bolts and the second bores serving as the connection with the control element; and the first bevels, in a reciprocal effect with the cams, retaining the pushbutton in an end position; the first recesses limiting the travel of the pushbutton. Preferably, the closing ring includes a collar having a third cutout.

In a further embodiment of this invention the emergency stop switch control element includes second stops, bolts, third bores, second bevels, third bevels and second recesses; the second stops abutting the back side of the face plate; the bolts and the third bores serving as the connection with the closing ring; the second bevels and the third bevels, in a reciprocal effect with the cams, retaining the pushbutton in an end position; with the second recesses limiting the travel of the pushbutton.

In yet another embodiment of this invention, the emergency stop switch includes a first plunger element having a first top part and a first plunger portion; the first top part including third stops, with the third stops acting in a reciprocal manner with the first and second recesses; a first cutout; second slots and second slot fins serving as the connection with the pushbutton; a shoulder, with the shoulder activating the contact carrier; and wherein the first plunger portion includes first limbs, with the first limbs having a contact breaker on the ends thereof, and the contact breaker activating the contact arms. The first cutout includes second webs and first webs, with the first webs being raised, relative to the second webs, the webs serving for guiding and limiting the travel of the cams.

In yet a further embodiment of this invention, the emergency stop switch includes a second plunger element having a second top part, and a second plunger portion; the second top part includes fourth stops acting in a reciprocal manner with the first and second recesses; a second cutout; third slots and third slot fins with the third slots and third slot fins serving as the connection with the pushbutton; a shoulder for actuating the contact carrier; and fourth and fifth bevels for actuating the contact arms, wherein the second plunger portion includes second limbs, having fifth stops, with the second limbs carrying the contact guide. Preferably, the second cutout includes fourth webs and third webs with the third webs being raised, relative to the fourth webs, the webs serving for guiding and limiting of the travel of the cams; and the contact guide includes a fourth cutout, fourth slots and sixth stops; the fourth cutout serving for guiding the contact arms; wherein the second limbs of the second plunger portion slide with the fourth slots and wherein the sixth stops stop the falling of the contact guide through an opening in the contact carrier.

In an additional embodiment of this invention, each cam includes a sixth bevel, a seventh bevel, a seventh stop, multiple flats, and a fourth bore; with the sixth and seventh bevels acting in a reciprocal manner with the first, second and third bevels, with the seventh stop sliding on the second or fourth webs; and wherein the flats slide on the first or third webs, and wherein the fourth bore receives an end of the first spring.

The advantages achieved by this invention chiefly reside in the fact that known switch components are utilized for a new use. An additional advantage resides in the fact that, due to the arrangement of the switch components and due to the modular constructional form, the assembly of the switch is accomplished without the use of tools. The use of existing switch components as well as the assembly without tools cause a lowering of production costs, which also makes the switch more price attractive relative to competitive products.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

Figure 1:
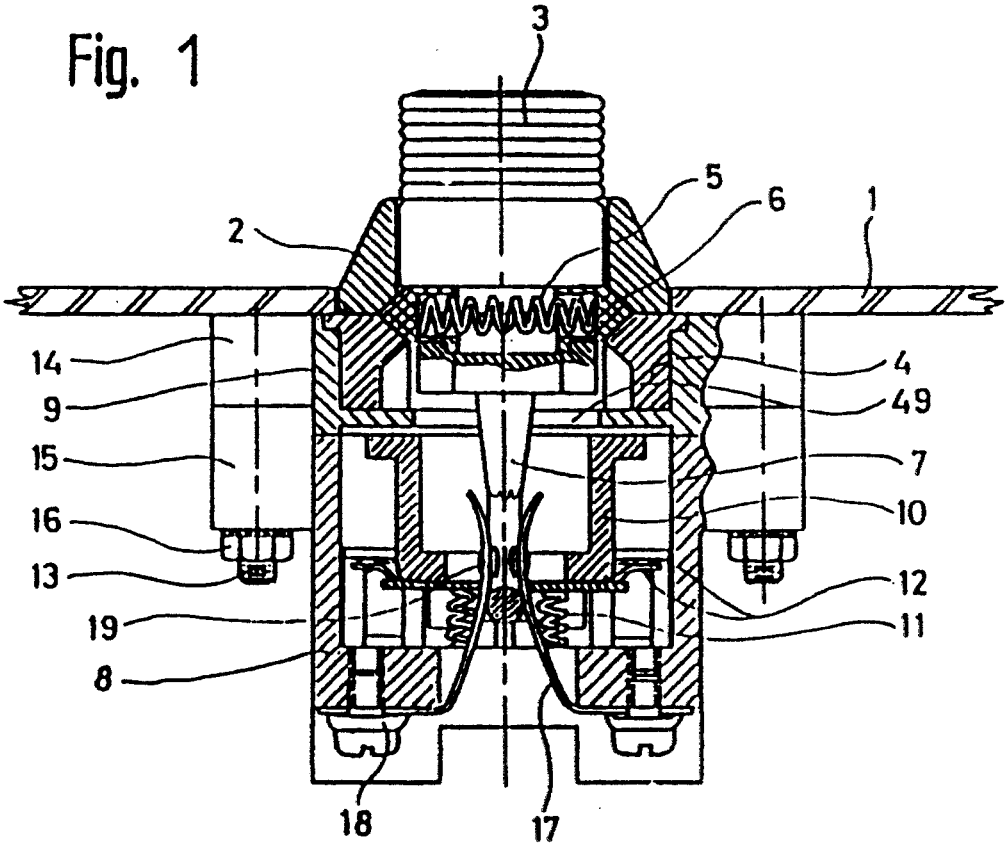
FIG. 1 is a cross sectional view of the emergency stop switch of this invention.

Numeral 1 in FIG. 1 designates a face plate, with a closing ring 2 penetrating therethrough. The closing ring 2 surrounds a pushbutton 3 and on its rear side is in communication with a contact element 4 that is provided for the guidance of cams 6 that are preloaded by a first or single spring 5. A first plunger element 7, in connection with pushbutton 3, includes means for the reception of cams 6 and first spring 5. An adaptor 9, superimposed on a contact block 8 surrounds control element 4. First plunger element 7 actuates, upon a force input via the pushing of pushbutton 3, a contact carrier 10, guided by contact block 8, against the resilient force provided by second or multiple springs 11, thereby opening contact sets 12 a first set of contacts being provided on contact block 8 and a second set of contacts being provided on contact carrier 19. Face plate 1 includes threaded bolts 13 which penetrate adaptor bosses 14 and contact block bosses 15. On the free ends of bolts 13, nuts 16 fixedly secure contact block 8. In place of the previously noted prior art incandescent lamp, arched contact arms 17 are utilized which are accessible via connecting terminals 18. Contact arms 17 are pretensioned in such a manner that they close contacts 19 upon the pushing of pushbutton 3.

Figure 2:
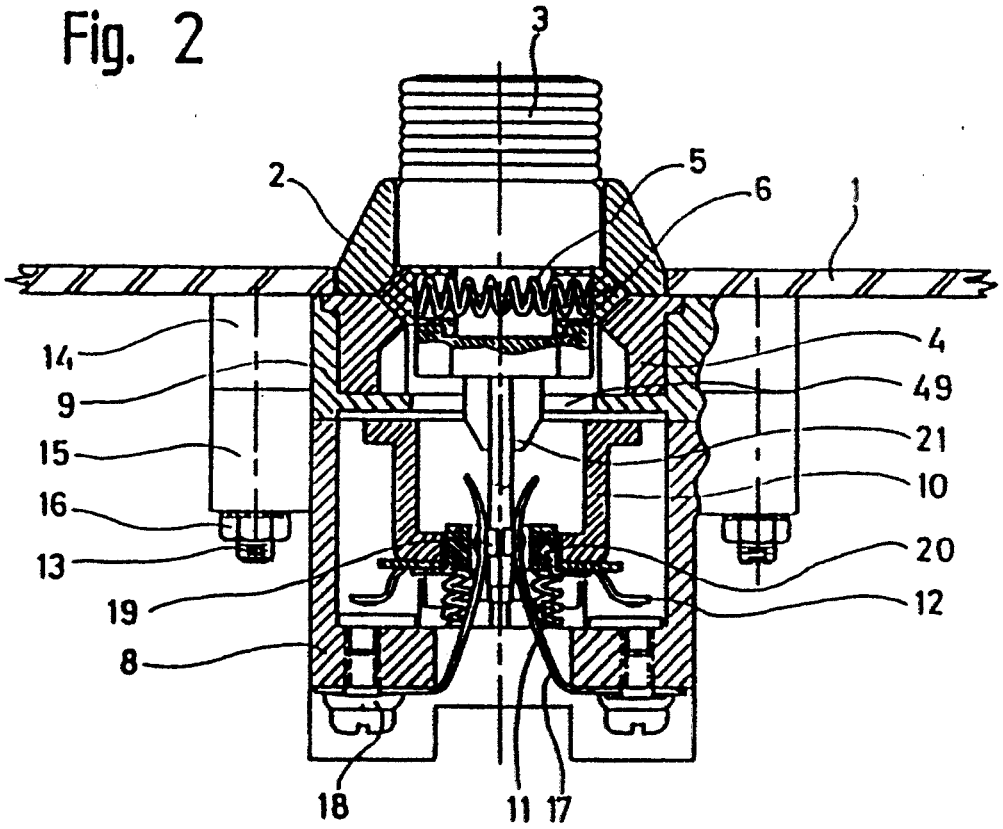
FIG. 2 is a cross sectional view of a further embodiment of the emergency stop switch of this invention.
Figure 3:
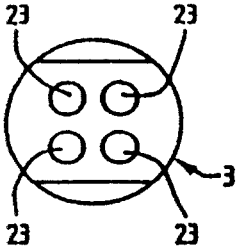
FIG. 3 is a bottom view of a pushbutton of the emergency stop switch of this invention.
Figure 4:
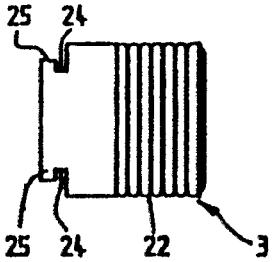
FIG. 4 is a side view of the pushbutton.
Figure 5:
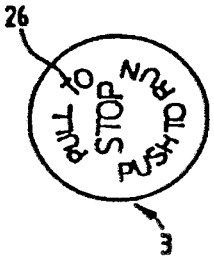
FIG. 5 is a top view of the pushbutton with an indicia marking.
Figure 6:
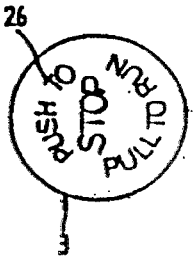
FIG. 6 is a top view of the pushbutton with a further indicia marking.
Figure 7:
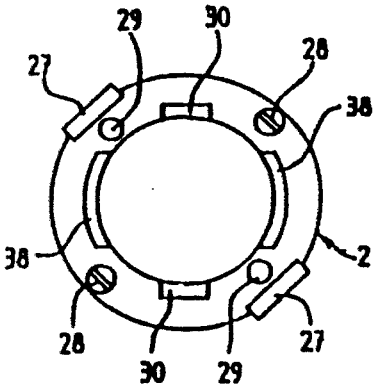
FIG. 7 is a bottom view of a closing ring of the emergency stop switch of this invention.
Figure 8:
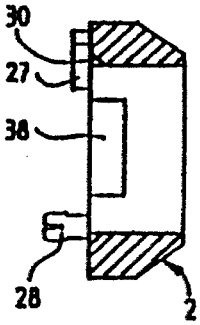
FIG. 8 is a cross sectional view of the closing ring.
Figure 9:
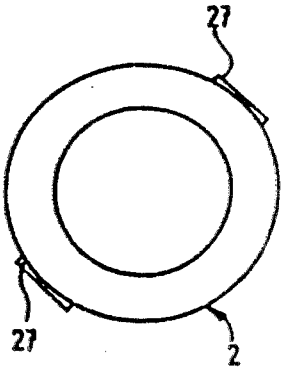
FIG. 9 is a top view of the closing ring.

FIG. 2 illustrates a further embodiment or variation of the emergency stop switch of FIG. 1. The switch is constructed in such a manner that, upon actuation of pushbutton 3, contact sets 12 are closed and contacts or contact area 19 are opened. Contact arms 17 extend through a contact guide 20 which is displaceably arranged on a second or different plunger element 21. The functioning manner of second plunger element 21 will be described in more detail in the description of FIGS. 17 to 20.

The structure and function of pushbutton 3 is described in more detail in the description of FIGS. 3 to 6. In order to increase the gripping or handling properties of pushbutton 3, its pushbutton body 22 is provided with a structured or patterned peripheral surface. The underside of pushbutton 3 is provided with material-saving first bores 23. On the face or side, opposing the front face, first slots 24 and first slot fins 25 are utilized and serve as the connection with the first or second plunger element 7 or 21, respectively. The front or top face of pushbutton 3 is provided with legend or indicia markings 26 which provide the user with switch-specific information.

The details of closing ring 2 are described in more detail in the description of FIGS. 7 to 9 and 26. First stops 27 abut the back side of face plate 1 and stop the falling of closing ring 2 through the opening in face plate 1. Spring bolts 28 and second bores 29 serve as the connection with control element 4. First bevels 30 retain cam 6 in the first end position of pushbutton 3, as shown in FIG. 1. First recesses 38 limit the movement of pushbutton 3 in the first end position. In a further embodiment, shown in FIG. 26, closing ring 2 includes a collar 31 with a third cutout 32, thereby assuring a mechanical protection ring for pushbutton 3.

Figure 10:
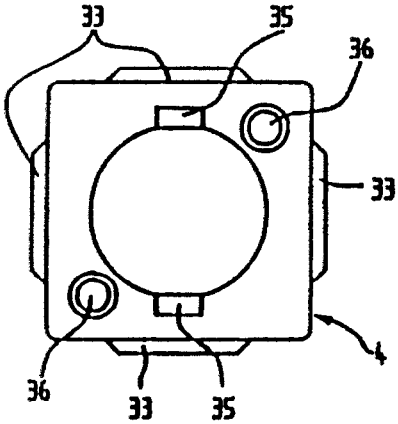
FIG. 10 is a top view of a control element of the emergency stop switch of this invention.
Figure 11:
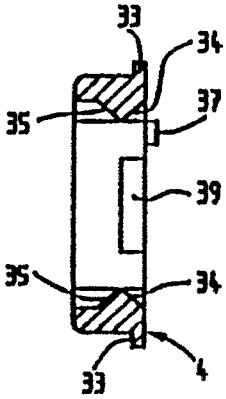
FIG. 11 is a cross sectional view of the control element.
Figure 12:
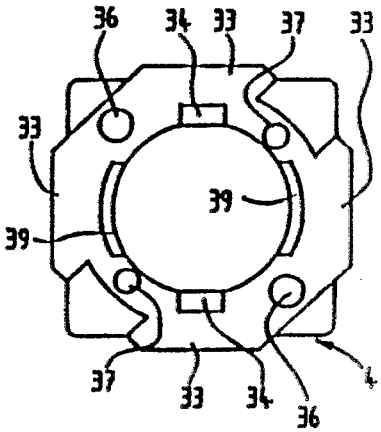
FIG. 12 is a bottom view of the control element.
Figure 13:
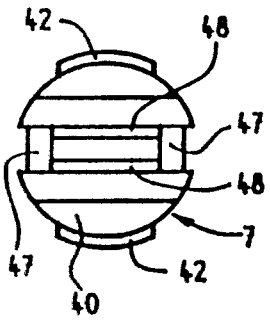
FIG. 13 is a top view of a first plunger element of the emergency stop switch of this invention.
Figure 14:
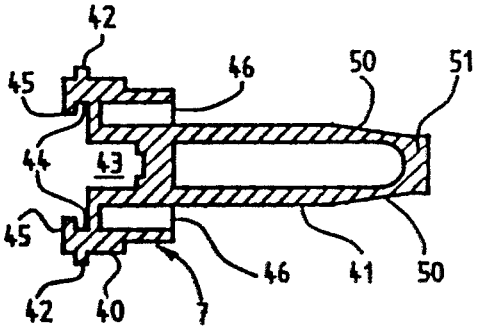
FIG. 14 is a cross sectional view of the first plunger element.
Figure 15:
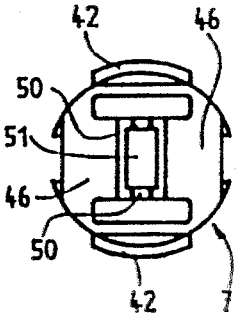
FIG. 15 is a bottom view of the first plunger element.
Figure 16:
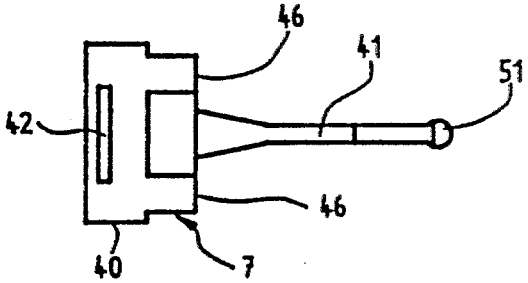
FIG. 16 is a side view of the first plunger element.
Figure 17:
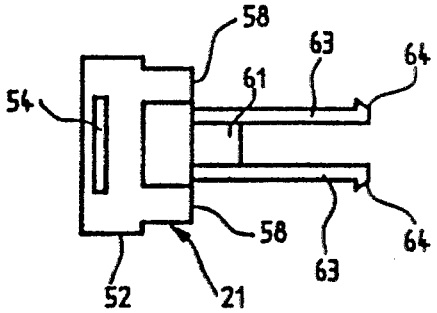
FIG. 17 is a side view of a second plunger element of the emergency stop switch of this invention.
Figure 18:
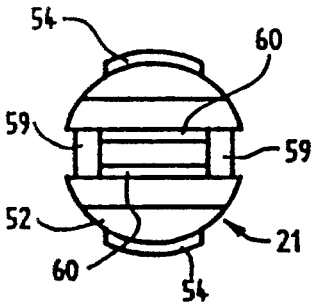
FIG. 18 is a top view of the second plunger element.
Figure 19:
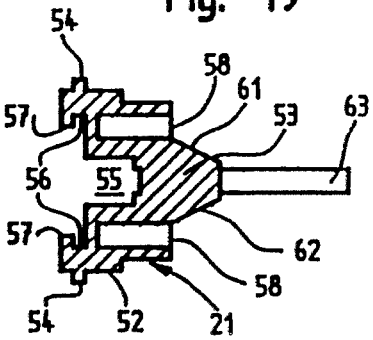
FIG. 19 is a cross sectional view of the second plunger element.
Figure 20:
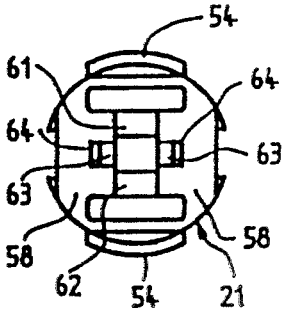
FIG. 20 is a bottom view of the second plunger element.

The details of control element 4 are described in more detail in the description of FIGS. 10 to 12. Adaptor 9 surrounds control element 4 in such a manner that a second stop 33 abuts face plate 1. In the end position of pushbutton 3, shown in FIG. 1, cams 6 are retained via first bevels 30, shown in FIGS. 7 and 8 and second bevels 34, shown in FIGS. 11 and 12. When pushbutton 3 is brought to a second end position, via the actuation thereof, cams 6 are retained by third bevels 35. Third bores 36 contain the spring bolts 28 of closing ring. 2, with bolts 37 gripping into second bores 29 of closing ring 2. Second recesses 39 limit the movement of pushbutton 3 in the second end position.

The details of first plunger element 7 are described in more detail in the description of FIGS. 13 to 16. First plunger element 7 is comprised of a first top part 40 and a first plunger portion 41. First top part 40 includes third stops 42, a first cutout 43, second slots 44, second slot fins 45 and a first shoulder 46. Upon the pushing or pulling of pushbutton 3, third stops 42 slide into first recesses 38 of closing ring 2 and into the second recesses 39 of control element 4 and thereby limit the travel of pushbutton 3. Within first cutout 43, second webs 48, and across from second webs 48, first webs 47, raised relative to webs 48, are arranged, which serve for the guiding and limiting the movement of cams 6. First slot fins 25 of pushbutton 3 extend into second slots 44 of first plunger element 7 and second slot fins 45 of first plunger element 7 extend into first slots 24 of pushbutton 3, thereby producing a positive connection between pushbutton 3 and first plunger element 7. Upon the pushing of pushbutton 3 first shoulder 46 of first plunger element 7 extends through an opening 49 in adaptor 9 and actuates contact carrier 10. First plunger portion 41 is comprised of first limbs 50 which are connected with first top part 40, with first limbs 50 being connected at their free ends, via a contact breaker 51. Upon the pulling of pushbutton 3, contact breaker 51 pushes apart contact arms 17 so that contacts 19 are opened.

The details of second plunger element 21 are described in more detail in the description of FIGS. 17 to 20. Second plunger element 21 is comprised of a second top part 52 and second plunger portion 53. Second top part 52 includes fourth stops 54, a second cutout 55, third slots 56, third slot fins 57 and a second shoulder 58. Upon the pushing or pulling of push button 3, fourth stops 54 slide into first recesses 38 of closing ring 2 and into second recesses 39 of control element 4 and thereby limit the travel of pushbutton 3. Within second recess 55, fourth webs 60, and across from fourth webs 60, third webs 59, raised relative to webs 60, are arranged, which serve for the guiding and limiting the movement of cams 6. First slot fins 25 of pushbutton 3 extend into third slots 56 of second plunger element 21 and third slot fins 57 of second plunger element 21 extend into first slots 24 of pushbutton 3, thereby producing a positive connection between pushbutton 3 and second plunger element 21. Upon the pushing of pushbutton 3, second shoulder 58 of second plunger element 21 extends through opening 49 in adaptor 9 and actuates contact carrier 10. Second plunger portion 53 is comprised of a fourth bevel 61 and a fifth bevel 62 as well as second limbs 63 which are connected with second top part 52, with second limbs 63 being provided with fifth stops 64 at their free ends. Upon the pushing of pushbutton 3, fourth bevel 61 and fifth bevel 62 push apart contact arms 17 so that contacts 19 are opened.

Figure 21:
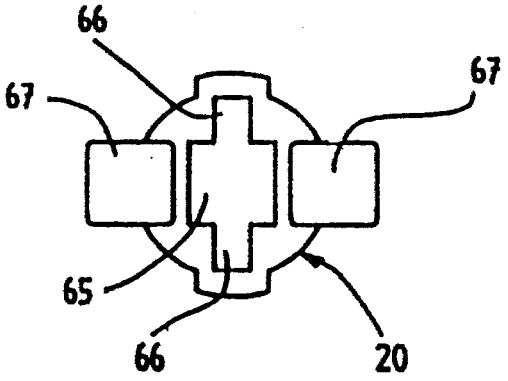
FIG. 21 is a bottom view of a contact guide of the emergency stop switch of this invention.
Figure 22:
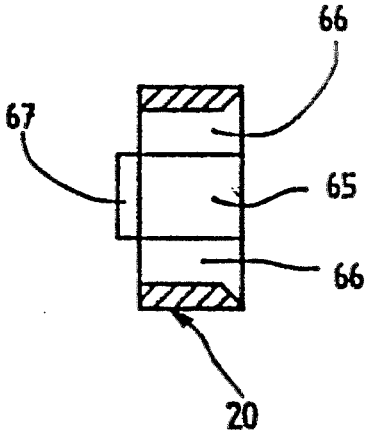
FIG. 22 is a cross sectional view of the contact guide.
Figure 23:
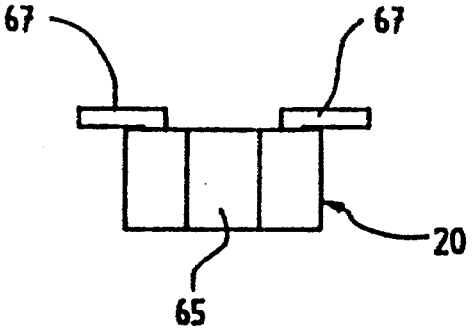
FIG. 23 is a side view of the contact guide.

The details of contact guide 20 are described in more detail in the description of FIGS. 21 to 23. Contact guide 20 includes a fourth cutout 65, fourth slots 66 and sixth stops 67. Contact arms 17 extend from fourth cutout 65 of contact guide 20. Second limbs 63 of second plunger element 21, slide, upon the pushing of pushbutton 3 along fourth slots 66 until second shoulder 58 of second plunger element 21 actuates contact carrier 10, whereby contact guide 20 is carried with contact carrier 10 via sixth stops 67. Upon the pulling of pushbutton 3, fifth stops 64 limit the glide path of second limbs 63.

Figure 24:
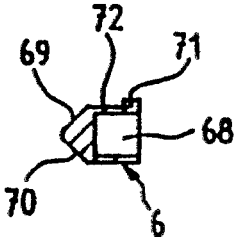
FIG. 24 is a cross sectional view of a cam of the emergency stop switch of this invention.
Figure 25:
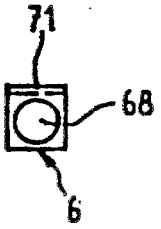
FIG. 25 is a bottom view of the cam.
Figure 26:
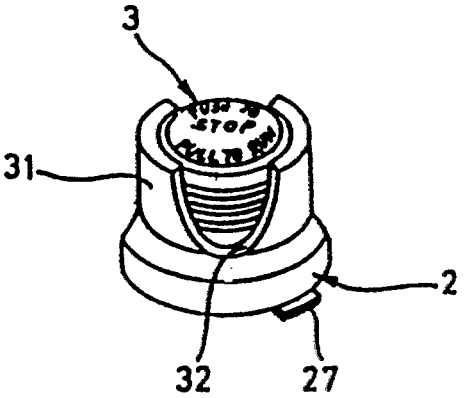
FIG. 26 is perspective representation of a further embodiment of the closing ring.

The details of cam 6 are described in more detail in the description of FIGS. 24 and 25. Cam 6 includes a fourth bore 68 which receives the end of first spring 5. Upon the pushing and pulling of pushbutton 3 the sixth bevel 69 and the seventh bevel 70 slide along the second bevel 34 and along the third bevel 35 of control element 4. In this manner a seventh stop 71 slides upon the second webs 48 or fourth webs 60 and upon a area or surface 72 on raised first webs 47 or raised third webs 59.

While there are shown and described present preferred embodiments of the invention, it is to be distinctly understood that the invention is not limited thereto, but may be otherwise variously embodied and practiced within the scope of the following claims and the reasonably equivalent structures thereto.

What is claimed is:

1. An emergency stop switch comprising:

an adaptor having a first end supported on a contact block having a first set of contacts;

a contact carrier movably mounted within said contact block and provided with a second set of contacts adapted for contacting the first set of contacts;

a closing ring and a pushbutton slidably mounted in said closing ring, the pushbutton including first bores on an underside thereof, with the pushbutton being slidably engagable with said contact carrier between first and second positions to actuate the first and second contact sets on the contact carrier, and the contact carrier being arranged within the contact block and being biased against movement of said pushbutton by a force of multiple springs;

means for connecting the adaptor and the contact block, via adaptor bosses and contact block bosses, with a face plate having an opening in alignment with said adaptor;

at least two contact arms, each contact arm having a contact area, with the contact arms being mounted on the contact block;

the contact arms being actuated via a plunger element, with the plunger element being in connection with the pushbutton;

a control element, within the adaptor; and multiple cams movably mounted on said plunger element, with the cams being guided by the plunger element and biased by a single spring toward first bevels arranged on the closing ring and second bevels arranged on the control element to retain said pushbutton in one of first or second position;

wherein the closing ring is mounted in said opening at said face plate and further includes first stops, spring bolts, second bores, said first bevels and first recesses; the first stops preventing the closing ring from moving through said opening of the face plate; the spring bolts and the second bores serving as the connection with the control element; and the first bevels in conjunction with the second bevels, in cooperation with the cams, retaining the pushbutton in one of said first and second positions; and wherein the plunger element includes flanges located within the first recesses for limiting the travel of the pushbutton between said first and second positions.

2. The emergency stop switch of claim 1, wherein the control element includes second stops, bolts, third bores, second bevels, third bevels and second recesses; the second stops abutting on the back side of the face plate; the bolts and the third bores serving as the connection with the closing ring; the second bevels and the third bevels, in cooperation with the cams, retaining the pushbutton in an end position; and wherein the second recesses limit the travel of the pushbutton.

3. The emergency stop switch of claim 2, wherein the plunger element is a first plunger element having a first top part and a first plunger portion; the first top part including third stops, with the third stops acting in a reciprocal manner with the first and second recesses; a first cutout; second slots and second slot fins serving as the connection with the pushbutton; a shoulder, with the shoulder activating the contact carrier; and wherein the first plunger portion includes first limbs, with the first limbs having a contact breaker on the ends thereof, and the contact breaker activating the contact arms.

4. The emergency stop switch of claim 3, wherein the first cutout includes first and second webs, with the first webs being raised, relative to the second webs, the first and second webs serving for guiding and limiting the travel of the cams.

5. The emergency stop switch of claim 3, wherein the plunger element is a second plunger element having a second top part, and a second plunger portion; the second top part includes fourth stops acting in a reciprocal manner with the first and second recesses; a second cutout; third slots and third slot fins with the third slots and third slot fins serving as the connection with the pushbutton; a shoulder for actuating the contact carrier; and fourth and fifth bevels for actuating the contact arms, wherein the second plunger portion includes second limbs, having fifth stops, with the second limbs carrying the contact guide.

6. The emergency stop switch of claim 5, wherein the closing ring includes a collar having a third cutout.

7. The emergency stop switch of claim 5, wherein the second cutout includes fourth webs and third webs with the third webs being raised, relative to the fourth webs, the webs serving for guiding and limiting of the travel of the cams.

8. The emergency stop switch of claim 5, wherein the contact guide includes a fourth cutout, fourth slots and sixth stops; the fourth cutout serving for guiding the contact arms; wherein the second limbs of the second plunger portion slide with the fourth slots and wherein the sixth stops stop the falling of the contact guide through an opening in the contact carrier.

9. The emergency stop switch of claim 8, wherein each cam includes a sixth bevel, a seventh bevel, a seventh stop, a surface, and a fourth bore; with the sixth and seventh bevels acting in a reciprocal manner with the first, second and third bevels, with the seventh stop sliding on the second or fourth webs; and wherein each cam surface slides on the first or third webs, and wherein the fourth bore receives an end of the single spring.

10. An emergency stop switch comprising:

an adaptor having a first end supported on a contact block having a first set of contacts;

a contact carrier movably mounted within said contact block and provided with a second set of contacts adapted for contacting the first set of contacts;

a closing ring and a pushbutton slidably mounted in said closing ring, the pushbutton including first bores on an underside thereof, with the pushbutton being slidably engagable with said contact carrier between first and second positions to actuate the first and second contact sets on the contact carrier, and the contact carrier being arranged within the contact block and preloaded being biased against movement of said pushbutton by a force of multiple springs;

means for connecting the adaptor and the contact block, via adaptor bosses and contact block bosses, with a face plate;

at least two contact arms, each contact arm having a contact area, with the contact arms being mounted on the contact block;

the contact arms being actuated via a plunger element, with the plunger element being in connection with the pushbutton;

a control element, within the adaptor; and multiple cams movably mounted on said plunger element, with the cams being guided by the plunger element and biased by of a single spring toward first bevels arranged on the closing ring and second bevels arranged on the control element to retain said pushbutton in one of first or second positions;

wherein the pushbutton further includes first slots and first slot fins wherein the first slots and first slot fins serve as the connection with the plunger element.

11. The emergency stop switch of claim 10, wherein the pushbutton includes a pushbutton body, the pushbutton body having a structured surface; the pushbutton further including material-saving first bores on an underside thereof, and the pushbutton also including indicia markings on a top face, with the indicia markings providing a user of the switch with switch-specific information.

* * * * *